US006544622B1

(12) United States Patent
Nomoto

(10) Patent No.: US 6,544,622 B1
(45) Date of Patent: Apr. 8, 2003

(54) ARAMID HONEYCOMBS AND A METHOD FOR PRODUCING THE SAME

(75) Inventor: Kazuhiko Nomoto, Akisima (JP)

(73) Assignee: Showa Aircraft Industry Co., Ltd., Tokyo (JP)

( * ) Notice: Subject to any disclaimer, the term of this patent is extended or adjusted under 35 U.S.C. 154(b) by 100 days.

(21) Appl. No.: 09/689,285

(22) Filed: Oct. 11, 2000

(30) Foreign Application Priority Data

Apr. 3, 2000 (JP) ..... 2000-100458

(51) Int. Cl.[7] ..... B32B 3/12

(52) U.S. Cl. ..... 428/116; 428/364; 428/375; 428/395; 428/475.5

(58) Field of Search ..... 428/116, 364, 428/375, 395, 475.5; 156/197

(56) References Cited

U.S. PATENT DOCUMENTS 4,729,921 A 3/1988 Tokarsky
5,137,768 A 8/1992 Lin
5,202,184 A * 4/1993 Brierre et al. ..... 428/371
5,320,892 A 6/1994 Hendren et al.
5,789,059 A * 8/1998 Nomoto ..... 428/116

FOREIGN PATENT DOCUMENTS

JP 4-226745 8/1992

* cited by examiner

*Primary Examiner*—Deborah Jones
*Assistant Examiner*—Ling Xu
(74) *Attorney, Agent, or Firm*—Baker Botts L.L.P.

(57) ABSTRACT

A novel aramid honeycombs 11 and a method therefor are provided, wherein aramid sheets 1 are used as the base material for forming cell walls 18 of the honeycombs 11. The aramid sheets 1 comprise para-aramid pulps 2, an amount of 40% by weight or less of para-aramid fibers 3 and a binder 4. Each of the aramid sheets 1 is calendered to produce pores 9, which extend from the outer surface to inside, with a porosity of 20% to 60%. Further, a reinforcing resin 10 is adhered to the cell walls 18 of the aramid sheets 1 and the pores are filled with the resin in an amount of 50% by volume based on the pore volume.

11 Claims, 7 Drawing Sheets

Relationship between the compression strength of the aramid honeycombs and the porosity of the aramid sheets Relationship between the compression strength of the aramid honeycombs and the porosity of the aramid sheets Relationship between the compression strength of the aramid honeycombs and the amount of the para-aramid fibers Relationship between the shear strength (W direction) of the aramid honeycombs and the amount of the para-aramid fibers Relationship between the shear strength (L direction) of the aramid honeycombs and the amount of the para-aramid fibers

ARAMID HONEYCOMBS AND A METHOD FOR PRODUCING THE SAME

BACKGROUND OF THE INVENTION

1. Field of the Invention

The present invention relates to aramid honeycombs and a method for producing the same. More particularly, the invention relates to a honeycomb core using aramid honeycomb sheets as base materials, and a method therefor.

2. Description of the Prior Art

Background

It has been known a honeycomb core structure comprising an assembly of a number of hollow, columnar honeycomb cells separated by cell walls adhered linearly to each other. Further, it has been also known to use aramid honeycomb sheets as base materials for the cell walls. Aramid honeycomb sheets comprising a nylon-type resin, particularly para-aramid honeycomb resin sheets, have flame-retardant, tough and other excellent properties required for a honeycomb core structure.

A honeycomb core structure comprising aramid honeycomb sheets used as the base materials for cell walls (hereinafter referred to as aramid honeycombs) is disclosed in Kokai (Jpn. unexamined patent publication) No. 4-226745. According to the publication, the aramid honeycomb sheets contain 0 to 50% by weight of a binder and 50 to 100% by weight of para-aramid fibers, wherein the para-aramid fibers represent 20% to 80% by volume of the total material.

The conventional aramid honeycombs, however, are defective in the following points.

First, the aramid sheets have a defective texture or structure. Sheets containing a large amount, i.e., 50% by weight or more, of para-aramid fibers are bulky and are inconvenient for handling. When the aramid paper sheets are produced, fibers are not uniformly stirred in a liquid such as water and, therefore, it is difficult to provide a papermaking treatment to the fibers to disperse the ingredients on a filter. Consequently, the produced aramid sheets are defective in that the para-aramid fibers are not uniformly dispersed and the sheet density is varied between portions of the sheets.

As a consequence, the sheets are wrinkled locally at portions differed in the number of para-aramid fibers, causing inconvenience in the operation of the production of the honeycombs. Further, a number of large pinholes are produced in sheets through which adhesives pass from one side surface to the other side. For these and other reasons, the production of the aramid honeycombs is often troubled.

Second, the paper sheet strength is defective. Since the sheets contain a large amount, i.e., 50% or more, of para-aramid fibers, Freeness value, i.e., a water-maintaining property and a water-filtering property, is unsatisfactory, resulting in the reduction in the bonding property of the binder mixed in a papermaking liquid, such as water. Since the binder is flowed off without being fixed to fibers and, thus, since the fibers are not bonded to each other, the paper strength of the aramid sheets decreases. Thus, when such aramid sheets are used as base materials, the produced honeycombs had an insufficient toughness.

Fibers have high restoring property. Therefore, thirdly, sheets become excessively thick when they are produced with a large amount, i.e., 50% or more, of para-aramid fibers since the fibers restore their volume after the sheets are produced and the sheets get thick, causing a reduction in sheet density. It was pointed out, therefore, that such thick sheets are inappropriate as base materials for honeycombs.

Prior Art

As has been mentioned above, the aramid honeycombs disclosed in said Kokai 4-226745 have problems caused by the sheets used as base materials. As a counter measure, meta-aramid pulps which act also as a binder were used and aramid sheets were provided with a calender treatment under a high. temperature and at a high pressure to be used as base materials for aramid honeycombs.

That is, meta-aramid pulps, which are excellent in a fixing property, have been used in addition to the main ingredient, i.e., 50% or more of para-aramid fibers, to overcome the problems of the lack in the fixing property and of the week paper strength. Further, the aramid sheets were, after provided with a paper-making treatment, calendered at a high temperature and under a high pressure to produce a thin film so as to overcome the third problems of being a thick sheet and of a reduction in density.

The meta-aramid pulp has a high softening point of over 200° C. Therefore, para-aramid fibers and meta-aramid pulps are merely entangled with each other in the sheet produced by a normal method with a paper-making liquid such as water and dried at 150° C. or lower.

That is, the meta-aramid pulps are not bonded in a liquid form to the para-aramid fibers, as is the case with a normal binder. Therefore, the sheets thus produced have not the strength sufficient for the production of aramid honeycombs.

To obtain the necessary strength, a high temperature and high pressure calendering treatment was needed according to the conventional processes. In fact, the aramid sheets after produced have been calendered under a high pressure of $29.4\times10^4$N/m(300 kg/cm) applied linearly and at a high temperature of around 300° C. In this way, the meta-aramid pulps were softened, melted, fluidized and then hardened to act just as a normal binder to obtain a sheet strength necessary for the production of aramid honeycombs.

Second, aramid honeycombs were produced using the aramid sheets as base materials by a conventional enlarging process which comprises the steps of applying adhesives linearly to the sheets, piling the sheets such that each of the sheets are shifted by a half pitch of the linearly applied adhesives, applying pressure to the piled sheets under heating to bond the sheets to each other, and enlarging the sheets to the direction counter to the piling direction to obtain aramid honeycombs comprising cell walls of the aramid sheets. The aramid honeycombs thus obtained were provided with an after treatment so that the cell walls are coated by and impregnated with a reinforcing resin.

Problems to be Solved by the Invention

For the conventional aramid honeycombs and the method therefor, following problems have been pointed out.

First, no improvement has been provided for solving the problem of the defective texture or structure.

The para-aramid fibers are still not uniformly dispersed and so are unevenly present in the sheets. The meta-aramid pulps, fluidized by the high pressure and high temperature calendering treatment, are used only to fill in between para-aramid fibers. Consequently, the density in sheets is varied locally and is scattered. Thus, the heat shrinkage ratio is different between the portions containing much fibers and those containing less fibers, and the sheets at the cooling stage are not uniformly shrank under heat.

Therefore, the aramid sheets conventionally used are not smooth, and are liable to be wrinkled. Since the sheets are defective in preciseness, they are difficult in handling and are difficult to be piled precisely.

Further, there are cases where a number of large pinholes are formed in the aramid sheets. As the result, the adhesives applied linearly to the surface pass through the pinholes to the other surface under a high pressure and a high temperature, whereby each of the piled sheets is adhered to each other to form a block and the respective sheets are unable to be enlarged or expanded.

Second, a problem of the cost was pointed. For the conventional aramid sheets, expensive meta-aramid pulps are used and the honeycombs using the expensive aramid sheets are accordingly expensive.

Further, the conventional aramid sheets are provided with a calendering treatment under high temperature and high pressure. The cost for the treatment is added to the total production cost.

Third problem is related to the insufficient strength of the aramid honeycombs. The aramid sheets used as base materials for the honeycombs are calendered under a linear pressure of $29.4\times10^4$N/m(300 kg/cm) and at a temperature of around 300° C., and no many pores are retained since the melted, fluidized and hardened meta-aramid pulp fill in pores. After the sheets are formed to honeycombs, a reinforcing resin is applied to cell walls to strengthen the honeycombs.

According to the conventional aramid honeycombs, the resin covers only the sheet surface and does not penetrate thereinto since no many pores remain in the sheets.

As the result, the aramid honeycombs are easily broken by an external crushing or shearing force. That is, when the external force is applied, the reinforcing resin layer is apt to be peeled off at the interface, i.e., at the outer surface of the aramid sheets which form the cell walls, and so the layer sometimes does not work effectively for reinforcement.

Since the reinforcing resin is apt to be peeled off, there is a problem in the honeycomb strength. To solve the problem, the cell walls should be denser, causing another problem of heavier aramid honeycombs.

SUMMARY OF THE INVENTION

The present invention has been made to solve the above-mentioned drawbacks related to the conventional arts. According to the present invention, there are provided aramid honeycombs produced using para-aramid sheets comprising para-aramid pulps and a binder. Optionally 40% or less of para-aramid fibers are contained to form 100% with the para-aramid pulps.

The para-aramid sheets are calendered by a linear pressure of $19.6\times10^4$N/m or more and a temperature of 150° C. or higher such that the sheets have many pores with a porosity of 20% to 60% by volume. By an after treatment, a reinforcing resin is adhered to cell walls and the cell walls are impregnated with the resin.

The technical advantages obtained by the invention are that the texture or structure of the aramid sheets is improved whereby the honeycombs are produced smoothly, that the production cost is reduced and that the produced para-aramid honeycombs have an improved honeycomb strength.

Means for Solving the Problems

According to a first form of the invention, there are provided aramid-honeycombs comprising an assembly of a number of hollow columnar cells separated by cell walls, wherein a number of aramid sheets are used as the base materials for the cell walls, and said aramid sheets comprise para-aramid pulps and a binder and containing many pores after being provided with a calendering treatment, and the cell walls formed by the aramid sheets are coated by and are impregnated with a reinforcing resin, and pores in the cell walls also are filled with the resin.

According to a second form of the invention, there are provided aramid honeycombs according to the first form, but wherein said aramid sheets further comprise para-aramid fibers.

According to a third form of the invention, there are provided aramid honeycombs according to the second form, but wherein the para-aramid fibers comprise staple fibers of a staple or flock shape, and are used in an amount of 40% by weight or less of the total amount (100%) of the para-aramid pulps and said para-aramid fibers, and wherein the binder is used in an amount of 5% to 20% by weight to the total amount (100%) of the para-aramid pulps and said para-aramid fibers, i.e., 5–20:100.

According to a fourth form of the invention, there are provided aramid honeycombs according to the first form, but wherein the pores are produced from the surface to the inside of the aramid sheets, and have a porosity of 20% to 60% by volume.

According to a fifth form of the invention, there are provided aramid honeycombs according to the fourth form, but wherein 50% by volume or more of the pores are filled with the reinforcing resin.

According to a sixth form of the invention, there is provided a method for producing aramid honeycombs, which comprises the steps of:

preparing aramid sheets comprising para-aramid pulps, para-aramid fibers and a binder, calendering the aramid sheets such that many pores are produced and that the pores are adjusted to be retained, applying adhesives linearly to the aramid sheets,.

piling the aramid sheets such that each of the sheets is shifted to the other by half a pitch of the lines of the applied adhesives, applying pressure to the piled sheets under heating to bond the sheets with each other, enlarging the sheets to the direction counter to the piling direction to obtain aramid honeycombs comprising an assembly of a number of cells separated by cell walls composed of the aramid sheets as the base materials, and providing an after treatment of adhering a reinforcing resin to the cell walls and of impregnation so that the pores may be filled with the resin.

According to a seventh form of the invention, there is provided a method for producing aramid honeycombs according to the sixth form, but wherein the calendering step is carried out with a linear pressure of $19.6\times10^4$N/m or more and at a temperature of 150° C. or higher.

Structure of the Invention

Thus, according to the present invention, aramid honeycombs are produced from para-aramid sheets which comprise 60% to 100% by weight of para-aramid pulps, 40% to 0% by weight of para-aramid fibers, and 5 to 20% by weight to the total of the pulps and the fibers, i.e., 100: 5–20.

The aramid sheets are calendered with a linear pressure of $19.6\times10^4$N/m or more and at a temperature of 150° C. or higher in such a manner that many pores are produced with a porosity of 20% to 60% by volume.

The cell walls, which produce the aramid honeycombs, are formed by applying adhesives linearly to aramid sheets, piling the sheets such that each of the sheets is shifted at a predetermined interval, applying heat and pressure to bond the sheets, and enlarging the sheets to the direction counter to the piling direction.

The aramid honeycombs thus formed are then provided with an after treatment by which cell walls are coated by and are impregnated with a reinforcing resin and the pores are filled in an amount of 50% or more with the resin.

The resin filling and penetrating into the inside of cell walls bonds strongly the para aramid pulps, para-aramid fibers and the binder constituting the cell walls. Further, the resin adhered to the surface of the cell walls is bonded three-dimensionally to the resin filling the inside of the cell walls.

BRIEF DESCRIPTION OF THE DRAWINGS

The present invention is explained in detail with reference to the attached drawings, wherein.

DESCRIPTION OF THE PREFERRED EMBODIMENTS

Structure of Aramid Sheet

Figure 2A:
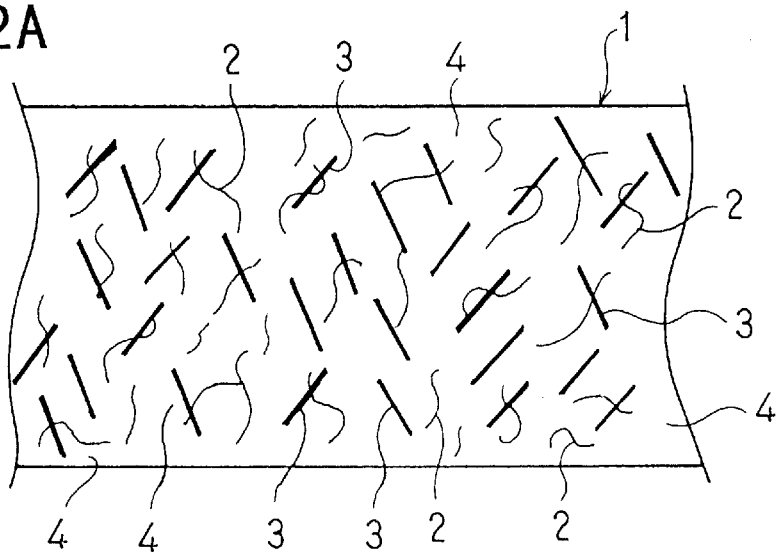
FIG. 2A is a plan view of the enlarged aramid sheet.
Figure 2B:
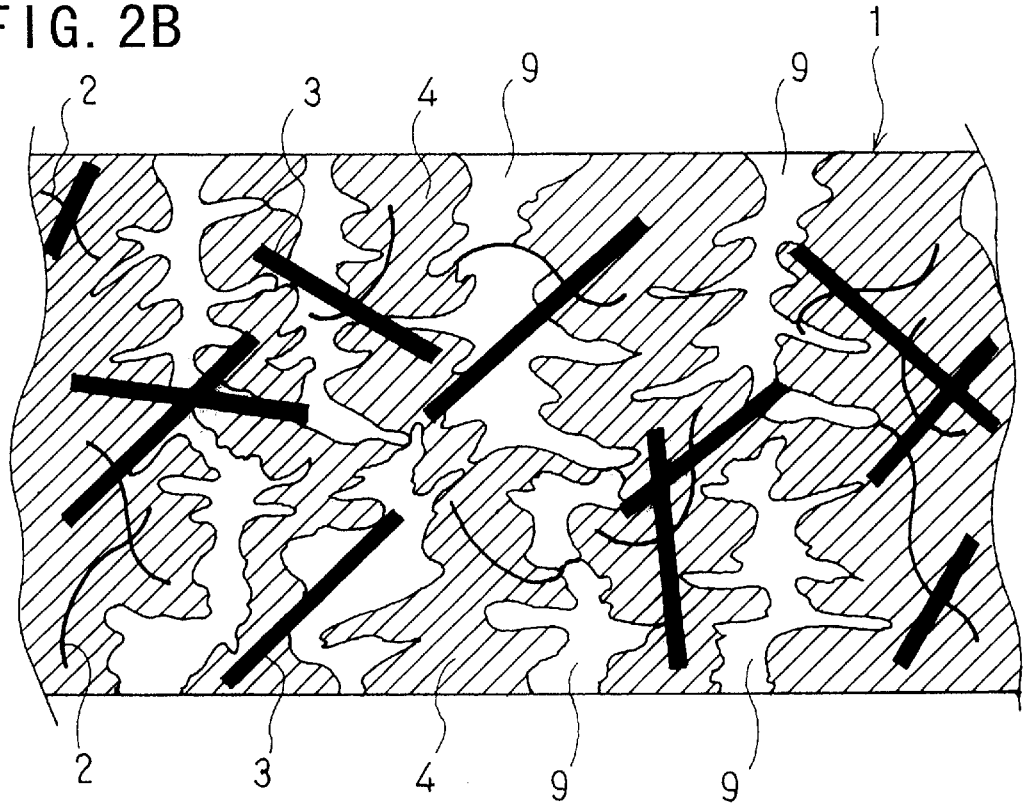
FIG. 2B is a sectional view of the enlarged aramid sheet.

As is shown in FIGS. 2A and 2B, the aramid sheet I used as a base material for the honeycomb contains para-aramid pulps 2, optionally mixed para-aramid fibers 3, and a binder 4.

The pulps 2 are obtained by treating para-aramid fibers 3 as starting materials, which are fibers of a nylon type resin, with a solution of a sulfuric acid, etc., and by chopping the treated fibers to pieces of from 3 mm to 10 mm length for example, by a chopper. The chopped, and extremely thin para-aramid pulps 2 are preferably curled so that they may be easily entangled with each other, and preferably have from 20 to 700 Freeness (water-retaining property, water-filtering property).

The para-aramid pulps 2 are used as the main ingredient of the aramid sheet 1, and are contained in the sheet in an amount of from 60 to 100% by weight based on the total amount (100% by weight) of the pulps 2 and the para-aramid fibers 3, i.e., 100: 60 or more.

The para-aramid fibers 3 are obtained by chopping starting materials to pieces to have flock or staple fiber shapes. The fibers are thin and are curled, and have a length of about 3 mm to about 10 mm, and a fineness of from 0.3 to 3.0 denier (one denier fineness equals to the fineness of a yarn weighing one gram for each 9,000 meters).

The para-aramid fibers 3 are used in the sheet 1 in an amount of from 0 to 40% by weight based on the total amount (100% by weight) of the para-aramid pulps 2 and the fibers 3, as is seen in Examples shown later, i.e., 50 or less: 100.

The binder 4 is used to bond or connect the pulps 2 and the fibers 3 with each other after the binder is softened under heat, melted and hardened and whereby the binder 4 provides the aramid sheet with the strength sufficient for a non-woven sheet.

A resin type binder is preferred. For example, vinyl type resins such as a PVA (polyvinyl alcohol), phenolic resins, acrylate resins and other water-soluble thermosetting or thermoplastic resins are used. The binder 4 is dispersed or emulsified in a paper making liquid such as water when a papermaking step is carried out.

The binder 4 is used in the aramid sheet 1 in an amount of from 5 to 20% by weight ratio based on the total amount (100% by weight) of the pulps 2 and the fibers 3, that is, in a ratio of 100: 5 to 100: 20. When the amount is less than 5%, the bonding or connecting power is insufficient, while if the amount is over 20%, the binder is flowed out, causing a trouble in the paper-making process.

When a binder 4 is used which adheres strong to a pair of metallic rollers 5 for calendering (see FIG. 1C), such as a PVA resin, a releasing agent is previously applied to the surface of the rollers 5 or the surface is coated with Teflon. The aramid sheet 1 contains the para-aramid pulps 2, para-aramid fibers 3 and the binder 4 in a composite manner.

Paper-making Work of Aramid Sheet

Figure 1A:
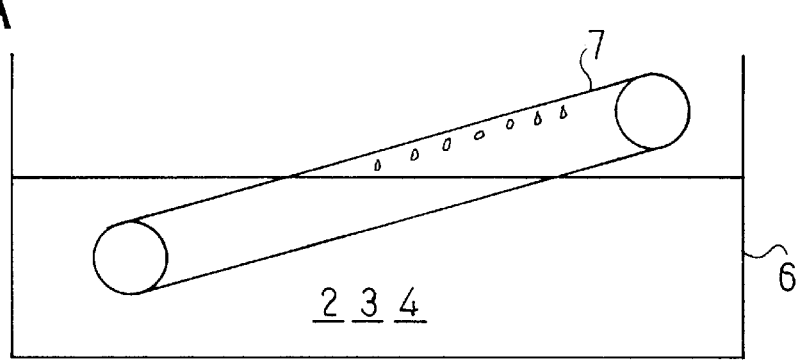
FIG. 1A is a side view explaining the paper-making step of an aramid sheet of the invention.
Figure 1B:
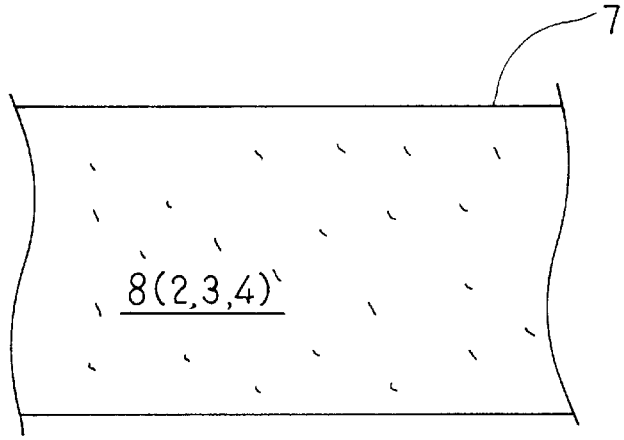
FIG. 1B is a plan view of the essential part of the obtained aramid sheet belt.

As shown in FIGS. 1A and 1B, the aramid sheet 1 is produced in accordance with a known paper-making process comprising disintegrating, beating, paper-making and drying steps from wood (cellulosic fibers, pulp) as a starting material using a conventional apparatus.

First, para-aramid pulps 2, para-aramid fibers 3 and a binder 4, etc., are introduced into a liquid tank 6. The tank has been filled with water or an aqueous solution of organic substances. The ingredients are stirred, dispersed, mixed and disintegrated.

The mixed liquid of the para-aramid pulps 2, the para-aramid fibers 3 and the binder 4 is separated by a separation sheet 7, which is a filter, into a solid part 8 constituting the aramid sheets 1, and a liquid part.

In FIG. 1A, the separation sheet 7 in a form of an inclined endless belt is shown. The sheet 7 moves from bottom toward the top of the mixture, whereby the solid part 8 is adsorbed on the sheet 7 while the liquid part flows through the sheet. 7.

The solid part 8, still wet, is removed of water content by a vacuum press and so on, and is wound around a drum while being heated at a temperature of from about 100° C. to about 150° C. to dry the moisture content, whereby an aramid sheet 1 as shown in FIG. 2A and 2B, comprising para-aramid pulps 2, para-aramid fibers 3 and a binder 4, is obtained.

Calendering

Figure 3A:
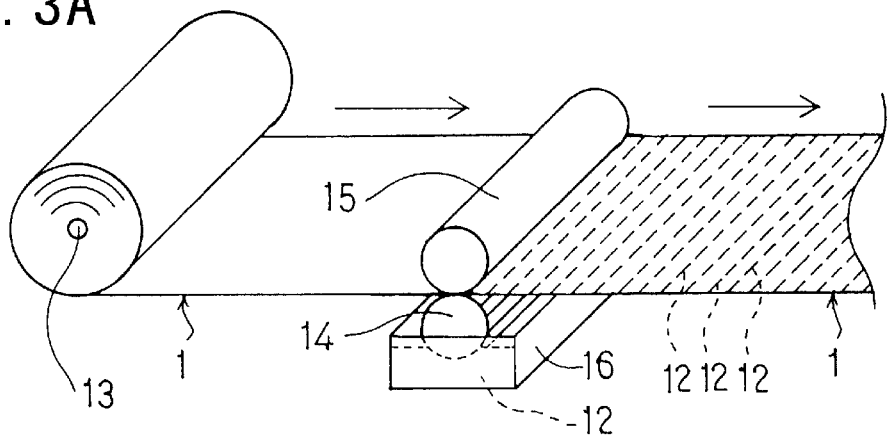
FIG. 3A is a perspective view explaining the adhesive-applying step.
Figure 3B:
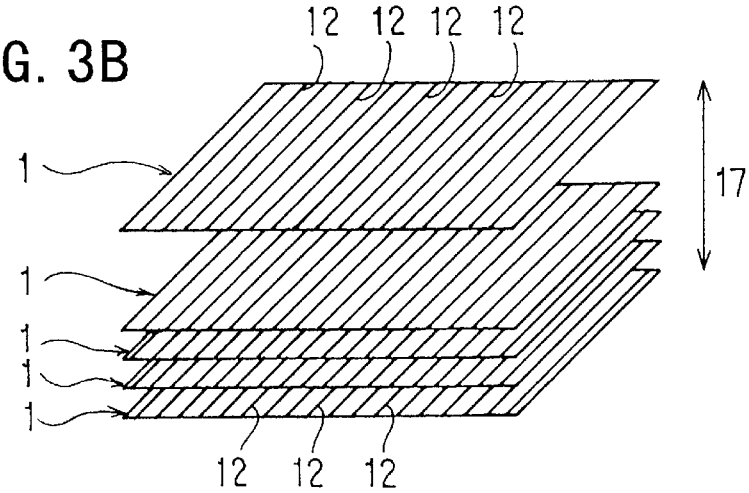
FIG. 3B is a perspective view explaining the piling step.
Figure 3C:
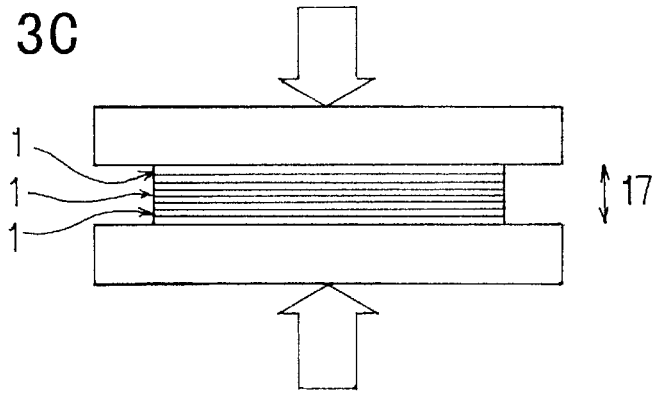
FIG. 3C is a front view explaining the pressing and heating step.

The aramid sheet 1 produced as above, is then provided with a calendering treatment by being rolled through a pair of heated metallic rollers 5 as shown in FIG. 3C. By the calendering, the resin binder 4 is softened, melted and hardened to provide the sheet with a strength sufficient for a non-woven paper sheet. Further, the sheet is flattened to an extremely thin and overall smooth film. In addition, pores 9 produced are adjusted to be retained.

The calendering process is carried out under a pressure of $19.6\times10^4$N/m (200 kg/cm) or higher applied linearly by a pair of metallic rollers 5 heated to 150° C. or higher. The pressure and/or temperature conditions vary depending on the composition of the aramid sheet 1 and other factors. When a pressure of lower than $19.6\times10^4$ N/m is applied, the density of the sheet 1 is reduced, resulting in a thick sheet which is not preferred for the production of honeycombs. The upper limit of the linear pressure is around $39.2\times10^4$N/m (400 kg/cm). When the temperature of the rollers 5 is lower than 150° C., the binder 4 is neither softened nor melted. The upper limit of the temperature is around 300° C.

As is seen from FIG. 2B, pores 9 remained in the sheet 1 are adjusted while many pores 9 are produced. The pores penetrate into the sheet from the sheet surface. They are retained, even after the sheet is calendered, in a form of vacant spaces between binders 4 which have been softened, melted and hardened to bond para-aramid pulps 2 and para-aramid fibers. In other words, the calendering treatment is effected in a manner to form and to retain many pores under a relatively low pressure applied linearly and a relatively low temperature. The porosity or pore ratio based on the total sheet 1 is from about 20 to 60% by volume.

The porosity A is calculated as follows:

First, the sheet weight M at 0 porosity is obtained by multiplying sheet thickness (t mm) by sheet area(s) and by the total density of the ingredients comprising pulps 2, fibers 3 and binder 4, etc., measured in accordance with JIS (Japanese Industrial Standard) P 8111 or ISO 187. Then, the actual sheet weight (m) is obtained and the actual weight (m) is divided by sheet weight (M). That is, the porosity A is obtained by the following formula:

$$A=m/M\times100$$

The porosity of the sheet 1 can be expressed also by sheet density (B), and the porosity of 20% to 60% substantially corresponds to the sheet density of 0.9 g/cm$^3$ to 0.4 g/cm$^3$. The sheet density B, expressed by g/cm$^3$, can be obtained by dividing the value of the sheet area (C) expressed in g/cm$^2$ in accordance with JIS P 8124 by the sheet thickness (t) expressed in cm in accordance with JIS P 8111 or ISO 187, and can be expressed by the following formula:

$$B=C/t$$

When the porosity, or the ratio of pores 9 to the sheet, is less than 20%, the filled amount of the reinforcing resin 10 (see FIG. 5B) becomes insufficient, resulting in reducing the honeycomb strength. If the porosity is over 60%, the filled amount of the reinforcing resin 10 becomes excessive, the sheet looks a resin made, also reducing the honeycomb strength (see examples shown later).

The actual porosity in the range between 20% to 60%, obtained after the calendering, depends on the composition of para-aramid pulps 2, para-aramid fibers 3, binder 4 and the like, linear pressure and temperature conditions at calendering, and so on. In other words, the pressure and temperature conditions can be set after a particular composition is set, so that the most appropriate porosity is obtained within the range between 20 to 60%.

For example, when the aramid sheet 1 is composed of 100 parts by weight of para-aramid pulps 2 having a Freeness value of 300, and 20 parts by weight of a binder 4 of an acrylic ester resin, the porosity is as follows:

A sheet was calendered by passing a raw sheet between a pair or metallic rollers 5 under a linear pressure of $19.6\times10^4$N/m (200 kg/cm) and a temperature of 200° C., at a feeding speed of from 50 m/min to 100 m/min. Then, pores 9 were produced and adjusted with a porosity of from 20% to 35% (sheet density: 0.9 g/cm$^3$ to 0.7 g/cm$^3$). In this instance, when the temperature condition was changed to 150° C., pores 9 were produced in a porosity of from 40% to 50% (sheet density: 0.6 g/cm$^3$ to 0.8 g/cm$^3$).

Next, when the aramid sheet 1 is composed of 60% by weight of para-aramid pulps 2 having a Freeness of 300, 40% of para-aramid fibers 3 having a fineness of 1.5 denier and a length of 6 mm, and 20% by weight of a binder 4 of an acrylic ester resin, i.e., 60: 40: 20, the porosity is as follows:

A sheet was calendered as before, by passing a raw sheet through a pair of metallic rollers 5 under a linear pressure of $19.6\times10^4$N/m (200 kg/cm) and a temperature of 200° C., at a feeding speed of from 50 m/min to 100m/min. Then, pores 9 were produced and adjusted with a porosity of from 30% to 50% (sheet density: 0.8 g/cm$^3$ to 0.6 g/cm$^3$). In this instance, when the temperature condition was changed to 150° C., the porosity was from 40% to 50% (sheet density: 0.7 g/cm$^3$ to 0.5 g/cm$^3$).

Forming of Aramid Honeycomb

The aramid honeycomb 11 is formed, after the sheet was produced and calendered and many pores 9 were formed and adjusted, by the steps 1) thorough 4) below, as illustrated respectively in FIGS. 3A, 3B and 3C, and FIG. 4A, from the produced sheet.

Step 1), an adhesives-applying step, is explained with reference to FIG. 3A, wherein an adhesive 12 is applied onto the aramid sheet 1. According to the invention, the adhesive 12 is applied along a number of lines at a certain width and a pitch to a belt of the aramid sheet 1 by any applying method or printing method. The adhesive may be a resin selected from epoxy resins, phenolic resins, acrylic resins polyimide resins and other resins.

In the figure, a belt-like aramid sheet 1 from a reel 13 is fed between a pair of an applying roller 14 and a pressing roller 15. Through the gears provided on the applying roller 14, the adhesive 12 contained in an adhesive tank 16 is applied or coated along a number of lines to one surface of the sheet 1 and is then dried.

Step 2, a piling step, is explained with reference to FIG. 2B, wherein the belt-like aramid sheet 1 is cut at a predetermined interval to a number of sheets. The cut sheets are piled one on top of the other, such that each of the sheets is shifted to the other by half a pitch or a half the interval of the applied adhesive 12.

The aramid sheet 1, which was coated with an adhesive 12 along a number of lines according to step 1, is cut at a certain interval. 400 pieces, for example, of the cut sheets are piled vertically, as shown by an arrow 17, to form a block, in such a positional relationship that each of the sheets 1 is shifted by half the interval of the lines of the coated adhesive 12.

Step 3, a bonding step, is explained. As shown in FIG. 3C, each of the piled sheets 1 are bonded to each other by pressure and heat. That is, a number of aramid sheets, which were piled by step 2 above, are then hot-pressed at the melting point of the adhesive 12. Then the adhesive coated along a number of lines are melted and hardened to bond the sheets with each other.

Figure 4A:
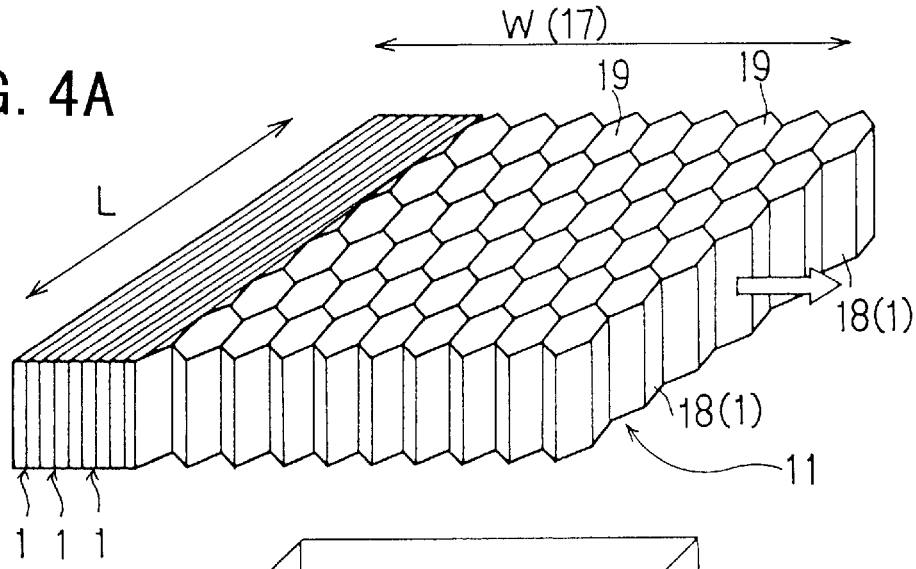
FIG. 4A is a perspective view explaining the enlarging step.

Step 4 is an enlarging step. The piled and bonded aramid sheets 1 are then enlarged to the direction counter to the piling direction by a tensile force or tension, as shown in FIG. 4A. In this step, a tensile force is applied to the direction shown by an arrow 17 in FIGS. 3B, 3C and 4A. Each of the sheets 1 are thereby expanded or extended between them such that the sheets are folded along the edges of the bonded portions and the portions not bonded are extended to the direction counter to the piling direction, i.e, the right-hand and left-hand direction in FIG. 4A, to separate the sheets from each other.

Thus, according to the enlarging method of the present invention, aramid honeycombs are formed by carrying out successively 1) adhesive applying or coating, 2) piling, 3) bonding and 4) enlarging steps. Consequently, there are formed honeycombs composed of a planar assembly of hollow, columnar cells 19 separated by cell walls 18 made of aramid sheets 1 which were bonded to each other along a number of lines and which were expanded.

After Treatment

Figure 4B:
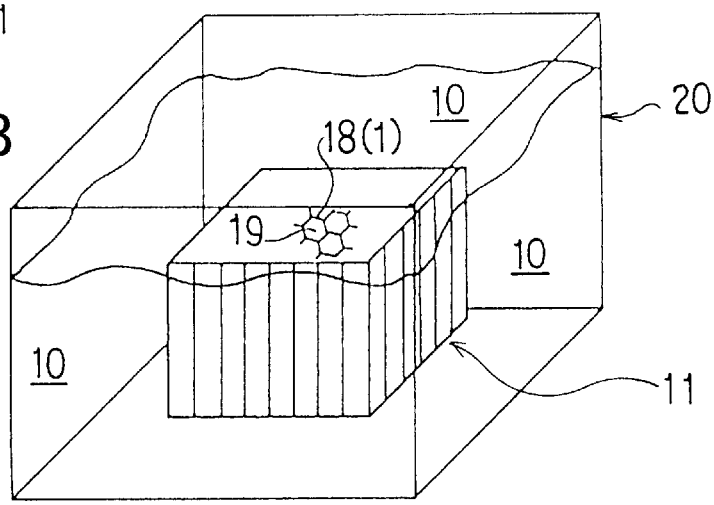
FIG. 4B is a perspective view explaining the reinforcing resin coating and impregnating step.
Figure 4C:
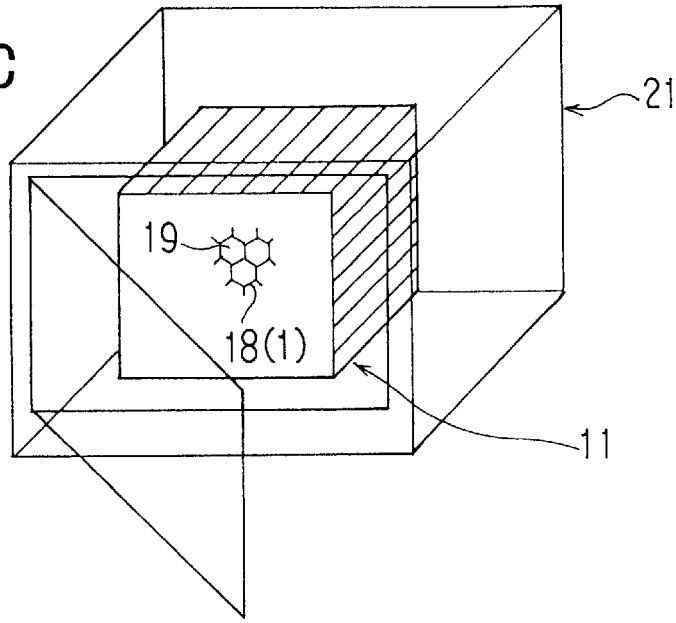
FIG. 4C is a perspective view explaining the drying step.

The aramid honeycombs thus formed are then provided with an after treatment by which cell walls 8 are coated by and are impregnated with a reinforcing resin 10 and pores 9 are filled in with the resin, as shown in FIGS. 4B and 4C. The structure of the formed honeycombs 11 is placed in a bath 20 containing the resin 10 to be impregnated therewith. The resin 10 is selected from phenolic resins, epoxy resins, polyimide resins and other thermosetting or thermoplastic resins, and is used in a varnish like liquid form wherein the resin is solved in a solvent in a solid ratio of 15 to 70% by weight.

The resin 10 adheres to and covers the surface of the cell walls 18 and fills in and penetrates into the pores 9. The inside of the cell walls also are impregnated with the resin.

After coated with the resin, the honeycombs 11 are taken out from the bath 20 and are dried in a drying furnace 21 by hot air as shown in FIG. 4C, whereby the solvent is removed and the adhered resin 10 is hardened or cured. The adhering step in the bath 20 and the drying step in the drying furnace 21 are repeated a plurality of times so that the cell walls 18 of the honeycombs 11 may be coated by and impregnated with a predetermined amount of the reinforcing resin 10.

The resin 10 fills in an amount of 50% to 100% by volume of the pores 9.

Figure 5A:
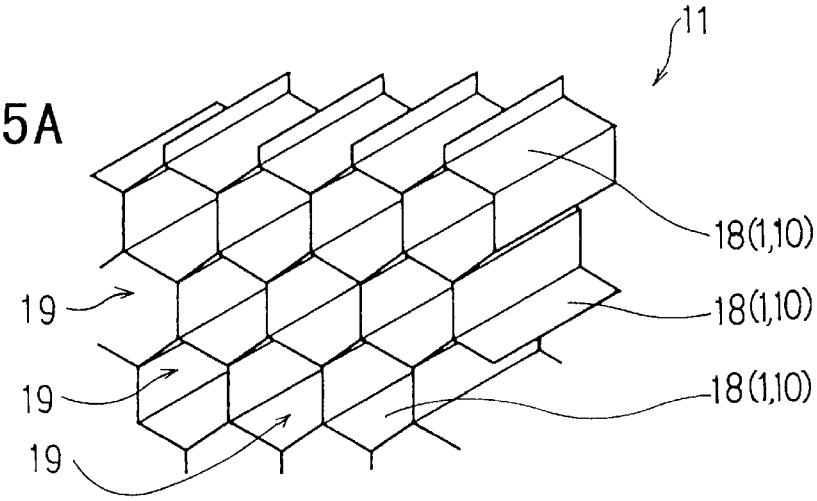
FIG. 5A is a perspective view of aramid honeycombs.
Figure 5B:
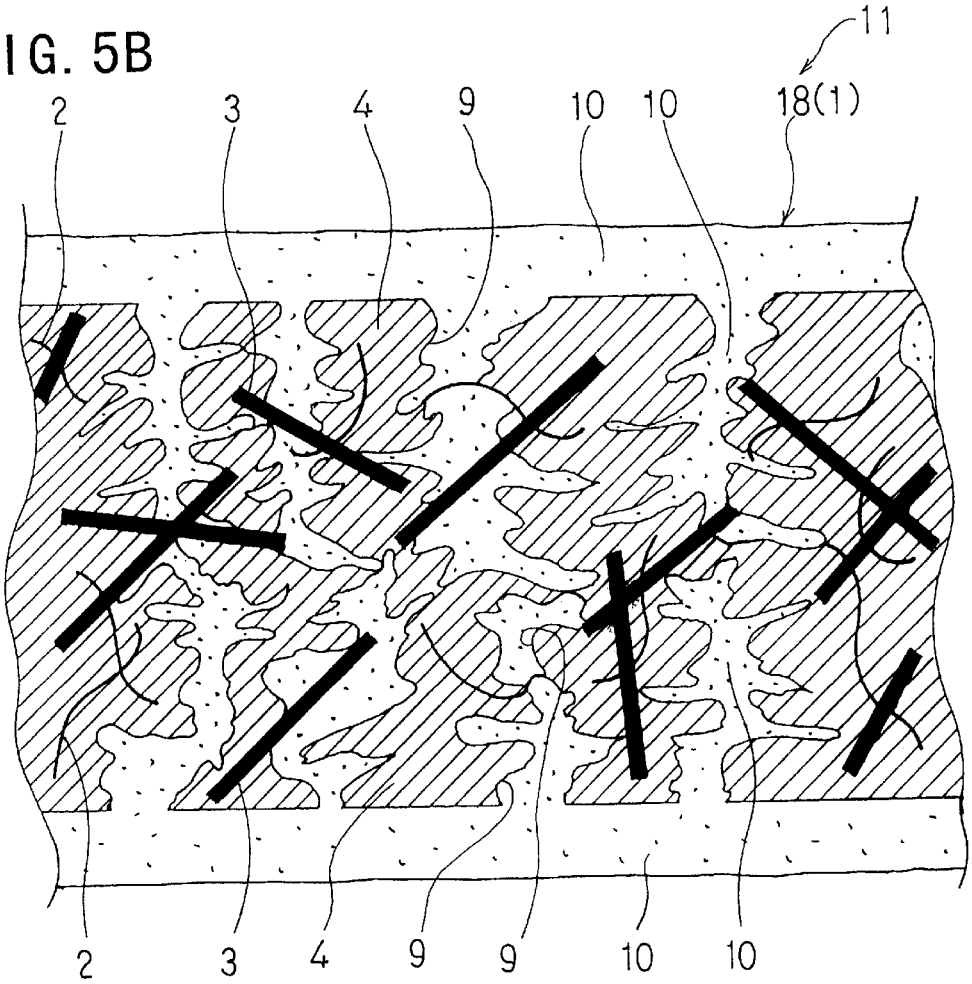
FIG. 5B is a sectional view of a part of cell walls of the honeycombs.

As has been stated with reference to FIG. 2B, many pores are produced and retained with a porosity of 20% to 60% of the sheet 1. FIG. 5B shows the state that full pore space (100%) is filed in by and impregnated with the reinforcing resin 10, but 50% or more of the pore space is generally filled.

Aramid Honeycombs

The aramid honeycombs 11 formed by steps 1) through 4) are coated with and are impregnated with the resin 10, and have a structure of an assembly of a number of hollow columnar cells 19 separated from each other by the cell walls 18 of aramid sheets 1.

The sheets comprise 60% to 100% by weight of para-aramid pulps, 40% by weight or less of para-aramid fibers 3, and a binder 4 of 5% to 20% by weight to the total amount of the pulps and the fibers, and is calendered in a way to retain many pores 9. The cell walls 18 formed by the sheets 1 are coated by and impregnated with the reinforcing resin 10, and the pores 9 are filled in with the resin.

The cell walls 18 and the cells 19 typically have an equilateral hexagon in a cross section, but may have other hexagonal form such as longitudinal or crosswise hexagonal, trapezoidal, approximately quadrangle form or other form. The aramid honeycombs are provided with a plate at both openings, i.e., at the ends of the cells, just as honeycombs generally used and are used as a honeycombs sandwiched panel.

The aramid honeycombs 11 and their sandwiched panel are excellent in the strength to weight, are light-weighted and have high honeycomb strength in rigidity and strength equal to those of other general honeycombs. Further, they have excellent characteristics in that they have good rectifying effect and have a large surface area per unit volume, etc. The honeycombs sandwiched panel is improved, in addition, in plain precision, in heat retaining property, in sound insulating property, and so on and are used as structural materials for various purposes. Since para-aramid sheets 1 are used as the base material for the aramid honeycombs 11, they are excellent particularly in a flame retarding property and in a honeycomb strength such as a compressive strength and sheering strength.

Functions and Effects

Figure 1C:
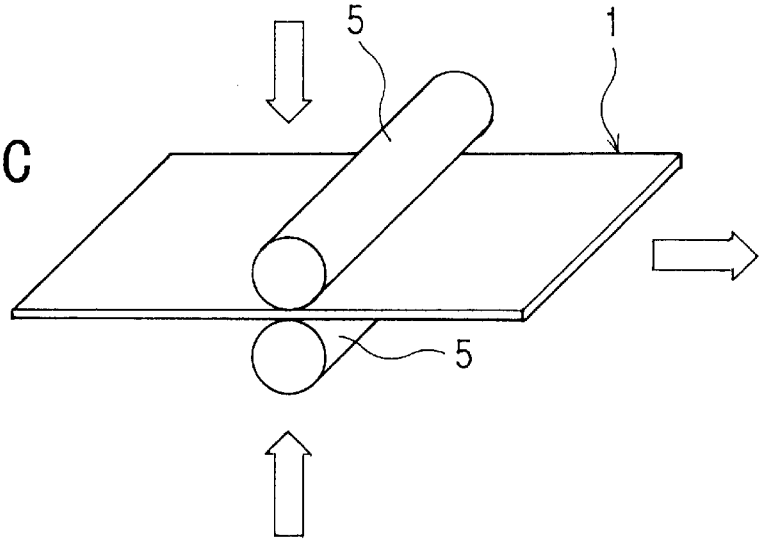
FIG. 1C is a perspective view explaining the calendering step.

According to the present invention, the aramid honeycombs 11 are composed of aramid sheets comprising 60% to 100% by weight of para-aramid pulps 2 as the main component, 0% to 40% by weight of para-aramid fibers 3, and a binder 4 of 5% to 20% by weight to he total amount (100%) of the pulps and the fibers as shown in FIGS. 2A, 2B, etc. The aramid sheet 1 is calendered under a linear pressure of $19.6\times10^4$N/m or more and a temperature of 200° C. or higher (FIG. 1C). In spite of being calendered, the sheets have many pores 9 produced and retained in a volumetric ratio of 20% to 60% (FIG. 2B).

The aramid honeycombs 11 defined by cell walls 18 made of aramid sheets 1 are produced by 1) applying an adhesive 12 linearly to the sheets, 2) piling the sheets at a positional relationship of half a pitch or half an interval of the applied adhesive shifted with each other, 3) bonding each of the sheets along the adhesive, and 4) enlarging each of the sheets by a tensile force applied to the direction counter to the piling direction. (FIGS. 3A, 3B, 3C, 4A and 5A).

Further, the cell walls 18 of thus produced honeycombs 11 are coated by and are impregnated with a reinforcing resin 10, and the pores 9 are filled in with the resin 10 with a porosity of 50% by volume or more.

Following points 1 through 3 are noted with respect to the aramid honeycombs 11 and the method therefor of the present invention.

According to the invention, the cell walls 18 are formed by aramid sheets 1, which comprise para-aramid pulps 2 as a main component. The sheets contain only 40% by weight or less of para-aramid fibers 3 which have an improper bulk dispersion and freeness value and have a high restoring property as shown in Examples.

Consequently, the aramid sheets used as the base material for the honeycombs are free from the reduction in the fixing capability of the binder 4 during a sheet-making process and thereby the strength necessary for the sheet is maintained. The density of the sheets is uniform overall and is neither varied nor diversified locally. The sheets shrink uniformly at cooling after a calendering treatment and are not wrinkled. Due to the calendering treatment, the sheet is processed to a thin film whereby less trouble is caused with respect to the thickness and the density.

As stated above, since the aramid honeycombs of the invention are produced from the aramid sheets 1 which are improved in texture or structure, they can be handled conveniently during production, can be precisely processed and can be easily piled.

Further, no many pinholes are produced which pass through the aramid sheet 1. Therefore, the adhesive 12 applied to the surface is free from the troubles of passing through from one surface to the other under heat and pressure to cause sheets to be adhered to each other in a block-like manner. For these reasons the aramid honeycombs 11 are smoothly piled, bonded and enlarged.

Second, the aramid sheets 1 used for cell walls 18 forming the aramid honeycombs contain relatively inexpensive para-aramid pulps 2, para-aramid fibers 3, a resin binder 4, etc., and expensive meta-aramid pulps and the like are not necessarily used. The calendering treatment is carried our relatively low, linear pressure of $19.6\times10^4$N/m or higher, and a relatively low temperature of 150° C. or somewhat higher, and is not carried out under costly high pressure or high temperature conditions.

Third, a reinforcing resin 10 is filled in and penetrate into pores 9 dispersed within cell walls 18, whereby the para-aramid pulps 2, para-aramid fibers 3 and the binder 4 are strongly bonded to each other. Further, the reinforcing resin 10 adhered to and covers the surface of cell walls 18, and the resin 10 penetrating into pores 9 form a strong, three-dimensionally woven structure.

Consequently, the reinforcing resin 10 will not be peeled off from the surface of the cell walls by an outer force and, in this way, the aramid honeycombs are improved in the mechanical strength such as a compressive strength and a sheering strength.

The aramid honeycombs 11 were tested according to MIL-STD-401 and the results showed excellent honeycomb strength, as follows:

The specific compressive force of the aramid honeycombs obtained by a stabilized compression test was from 21.6 kPa(kilopascal)/(kg/m$^3$) to 137.9 kPa/(kg/m$^3$) which corresponds approximately to from 50 psi/pcf (pound·square·inch/pound·cubic·feet) to 320 psi/pcf.

The specific sheer strength (L direction) obtained by a plate sheer test was from 12.9 kPa/(kg/m$^3$) to 73.3 kPa/(kg/m$^3$), i.e., approximately 30 psi/pcf to 170 psi/pcf. The L direction is a ribbon direction or extending direction W, i.e., the direction crossing the piling direction 17 (FIG. 4A).

The specific sheer strength (W direction) obtained by a plate sheer test was from 6.4 kPa/(kg/m$^3$) to 38.8 kPa/(kg/m$^3$), i.e., 15 psi/pcf to 90 psi/pcf. The W direction is an extending direction W.

The specific sheer elastic modulus (L direction) obtained by a plate sheer test was from 863 kPa/(kg/m$^3$) to 5,169 kPa/(kg/m$^3$), i.e., 2,000 psi/pcf to 12,000 psi/pcf.

The specific sheer elastic modulus (W direction) obtained by a plate sheer test was from 431 kPa/(kg/m$^3$) to 2588 kPa/(kg/m$^3$), i.e., 1,000 psi/pcf to 6,000 psi/pcf.

For further detail on the honeycomb strength, please see the testing method and results in Examples below.

EXAMPLES

Figure 6A:
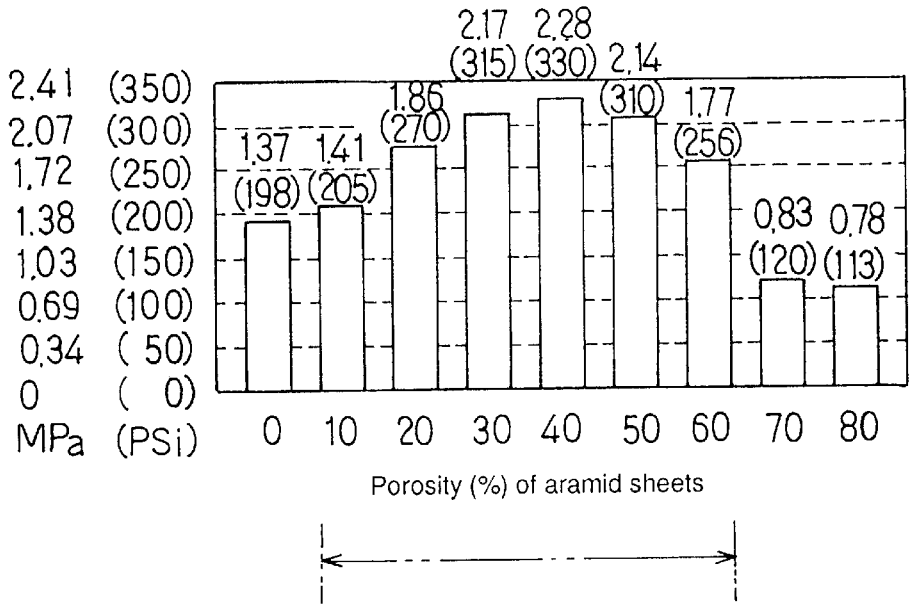
FIG. 6A is a graph showing the relationship between the compression strength of the aramid honeycombs and the porosity of the aramid sheets.
Figure 6B:
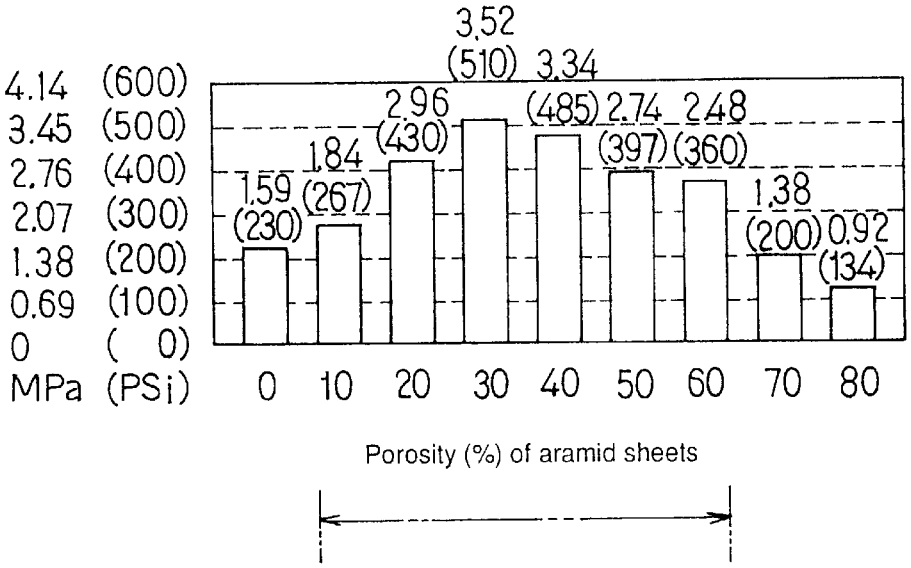
FIG. 6B is a graph showing the other relationship between the compression strength of the aramid honeycombs and the porosity of the aramid sheets of a composition different from that of FIG. 6A.

FIGS. 6A and 6B each shows a relationship between the compressive strength of aramid honeycombs 11 and the porosity of the aramid sheets 1.

1. For FIG. 6A, tests were made for aramid sheets 1 comprising 100% by weight of para-aramid pulps 2 and 15% by weight of an acrylic ester binder 4 (i.e., a ratio of 100: 15) and having a unit weight of 38 g/m$^2$. Further a solution of a phenol/methanol containing 40% by weight of solids, and having a viscosity of 360 mPa·s was used as the reinforcing resin 10 which adheres to the surface of cell walls 18 and fills in pores . The tests were made in accordance with MIL-STD-401 as compression strength tests.

As the result, the aramid honeycombs of the present invention, that is, those made of sheets having a porosity of from 20% to 60% have high values of the compressive strength and were judged to have a coat and impregnation of a proper amount of the reinforcing resin 10.

2. For FIG. 5B, tests were made for aramid sheets 1 comprising 60% by weight of para-aramid pulps 2, 40% by weight of para-aramid fibers 3 and 15% by weight of acrylic ester to 100% by weight of the total amount of the pulps and the fibers, i.e., a weight ratio of 60:40:15, and having a unit weight of 38 g/m$^2$. Further a solution of a phenol/methanol containing 40% by weight of solids, and having a viscosity of 360 mPa·s was used as the reinforcing resin 10 which adheres to the surface of cell walls 18 and fills in pores. The tests were made in accordance with MIL-STD-401 as compression strength tests.

The result also showed that the aramid honeycombs of the present invention, that is, those made of sheets having a porosity of from 20% to 60% have high values of the compressive strength and were judged to have a coat and impregnation of a proper amount of the reinforcing resin 10.

Figure 7A:
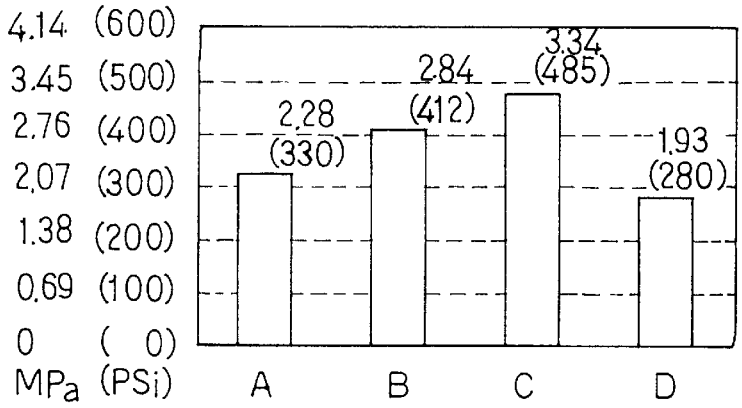
FIG. 7A is a graph showing the relationship between the compression strength of the aramid honeycombs and the amount of the para-aramid fibers.
Figure 7B:
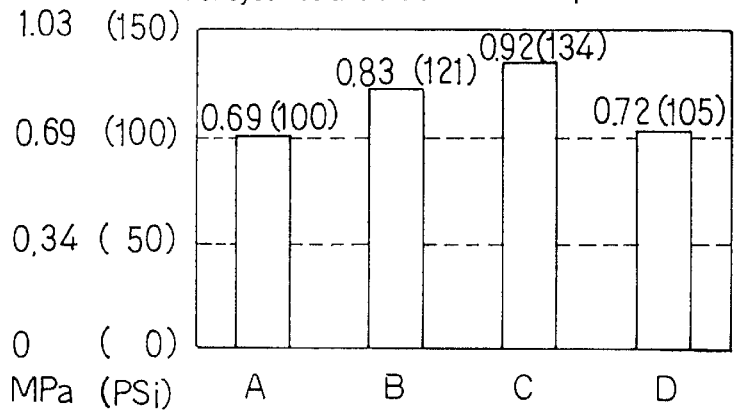
FIG. 7B is a graph showing the relationship between the shear strength (W direction) of the aramid honeycombs and the amount of the para-aramid fibers.
Figure 7C:
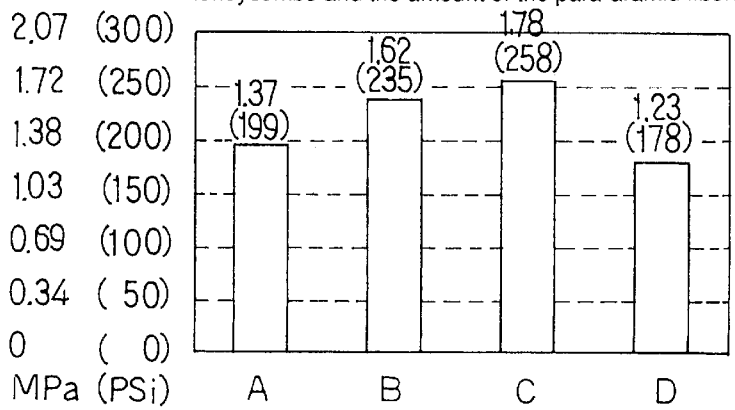
FIG. 7C is a graph showing the relationship between the shear strength (L direction) of the aramid honeycombs and the amount of the para-aramid fibers.

FIGS. 7A to 7C each shows the results of the tests made for the relationship between the strength of the aramid honeycombs 11 of the invention and the amount of para-aramid fibers 3 contained in aramid sheets 1. The tests were made in accordance with MIL-STD-401. Specifically, 3) FIG. 7A shows the result of the compressive strength of the aramid honeycombs 11, 4) FIG. 7B shows the result of the sheer strength (W direction) of the aramid honeycombs 11, and 5) FIG. 7C shows the result of the sheer strength (L direction) of the aramid honeycombs 11.

In each figure, A, B and C are the types of the aramid honeycombs 11 of the examples of the present invention, and D is that of a comparative example of prior arts.

For all of types A through D, aramid honeycombs having 3 pcf (48 kg/m$^3$) were used. Aramid sheets of types A, B and C of the examples of the invention contain 100% by weight of para-aramid pulps 2 and para-aramid fibers 3 and 15% by weight to the total amount (100%) of the pulps and the fibers, i.e., 100:15, of a binder resin of the kind similar to the para-aramid pulps and fibers. Further, the aramid sheets 1 for the aramid honeycombs of types A, B and C contain pores 9 with a porosity of 40%. The reinforcing resin 10 used to adhere to the surface of cell walls and to fill in the pores for types A, B and C is an aqueous solution of phenol/methanol resin solved in a solvent with a solid content of 40% by weight and having a viscosity of 360 mPa·s.

The aramid sheets 1 of the type A honeycombs contain 100% by weight of para-aramid pulps 2 and contain no para-aramid fibers 3.

The aramid sheets 1 of the type B honeycombs contain 80% by weight of para-aramid pulps 2 and 20% by weight of para-aramid fibers 3.

The aramid sheets 1 of the type C honeycombs contain 60% by weight of para-aramid pulps 2 and contain 40% by weight of para-aramid fibers 3.

The type D honeycombs of the comparative example contain 60% by weight of para-aramid fibers and 40% by weight of meta-aramid fibers which function as a binder. For type D, pores are scarcely produced or retained, and the reinforcing resin scarcely fills in the inside of cell walls.

For types A through D, the test results of 3) compressive strength (W) are shown in FIG. 7A, those of 4) sheer strength (W direction) are shown in FIG. 7B, and those of 5) sheer strength (L direction) are shown in FIG. 7C.

An examination of the results revealed that even the aramid honeycombs 11 of type A which use no para-aramid fibers 3 are superior to those of type D with respect to the honeycomb strength regarding 3) compressive strength (W), 4) sheer strength (W direction) and 5) sheer strength (L direction). Each of the 3), 4) and 5) strength of the honeycombs is improved depending on the increase in the amount of the para-aramid fibers 3, i.e., from type A to type C.

As is clear from the results, aramid honeycombs 11 of types A, B and C according to the examples of the present invention are much superior to those of type D of prior arts with respect to the 3), 4) and 5) strength.

For the working examples of the invention, when the ratio of the para-aramid fibers 3 exceeds 40% by weight, the texture or structure of the aramid sheets 1 suddenly becomes worse. For example, large pinholes passing through the sheets are liable to be produced causing the troubles that adhesives 12 pass through the sheets to the other surface during the production of the honeycombs 11.

Accordingly, it was revealed that the honeycomb strength increases by the level of 40% by weight of the para-aramid fibers 3, and that the 40% level is the upper limit of the content of the para-aramid fibers.

Technical Advantage

As has been explained, the para-aramid honeycombs and the process therefor of the invention use, as the base material, para-aramid sheets comprising para-aramid pulps and a binder. Optionally, para-aramid fibers of 40% by weight or less may be mixed.

A calendering treatment is carried out with a linear pressure of $19.6\times10^4$N/m or more and a temperature of 150° C. or higher such that many pores are produced and adjusted to have a porosity of 20% to 60%. By an after treatment, the cell walls are coated by and are impregnated with a reinforcing resin, and pores are filled with the resin in an amount of 50% by volume or more. As the result, following advantages are obtained.

First, the texture or structure of the base aramid sheets is improved, whereby the aramid honeycombs are smoothly produced. According to the present invention, the aramid sheets contain only 40% or less of the para-aramid fibers which are not dispersed well and have improper Freeness value. Therefore, there arise fewer problems related to conventional arts, such as insufficient paper strength, non-uniform sheet thickness, non-uniform heat shrinkage after calendering, and the production of wrinkles.

Since the aramid sheets to be used as the base materials are improved in the texture or structure, they can be handled effectively, have excellent in preciseness, and can be easily piled. Further, no many large pinholes are produced. Therefore, adhesives coated to one sheet surface will not pass to the other surface causing to adhering to other sheets and resulting in a block aggregate. In addition, an enlarging treatment can be carried out smoothly.

Secondly, the aramid honeycombs and the method therefor are cost saving. The aramid sheets contain relatively inexpensive para-aramid pulps, resin binder and para-aramid fibers. Further, the calendering treatment can be carried out under a relatively low pressure and low temperature conditions requiring reduced cost.

According to the invention, expensive meta-aramid pulps used in prior arts are not necessarily used, and no costly high pressure and high temperature calendering need not be carried out. Therefore the aramid honeycombs according to the invention can be produced at a relatively low cost.

Third, improved honeycomb strength is obtained. According to the present invention, the base aramid sheets have many pores after a calendering treatment and pores are filled in with the reinforcement resin which is applied as an after treatment of coating and impregnating the cell walls with the resin.

Due to the reinforcing resin filled in the inside of cell walls, the para-aramid pulps, para-aramid fibers and the binder composing the cell walls are strongly bonded to each other. Further, the reinforcing resin at the surface of the cell walls and the reinforcing resin inside the cell walls are also strongly bonded to each other.

The aramid honeycombs of the invention are improved in resistance to compression fracture and to shear fracture and, thus, improved in the honeycomb strength. When the honeycombs of the invention are required to have a honeycomb strength equal to those of the prior arts, the cell density of the former can be reduced whereby the total weight can be remarkably decreased.

Consequently, the problems suffered in conventional arts are removed according to the invention, and the advantages of the invention are evident.

LIST OF REFERENCES

1 . . . aramid sheet
2 . . . para-aramid pulp
3 . . . para-aramid fiber
4 . . . binder
5 . . . metallic roller
6 . . . liquid tank
7 . . . separation sheet
8 . . . solid part
9 . . . pore
10 . . . resin
11 . . . aramid honeycomb
12 . . . adhesive
13 . . . reel
14 . . . applying roller
15 . . . pressing roller
16 . . . adhesive tank
17 . . . piling direction
18 . . . cell wall
19 . . . cell

20 . . . tank
21 . . . drying furnace
L . . . ribbon direction
W . . . . extending direction.

What is claimed is:

1. Aramid honeycombs comprising an assembly having a plurality of hollow columnar cells separated by cell walls, wherein aramid sheets are used as a base material for said cell walls, said aramid sheets including para-aramid pulps as a main component, including a binder, and containing a plurality of pores, and wherein said cell walls formed by said aramid sheets are one of coated by and impregnated with a reinforcing resin, and said pores in said cell walls are filled with said resin.

2. Aramid honeycombs according to claim 1, wherein said aramid sheets further include para-aramid fibers.

3. Aramid honeycombs according to claim 2, wherein said para-aramid fibers include staple fibers of a staple or flock shape, and are used in an amount of 40% by weight or less of the total amount (100%) of said para-aramid pulps and said para-aramid fibers, and wherein said binder is used in an amount of 5% to 20% by weight to the total amount (100%) of said para-aramid pulps and said para-aramid fibers.

4. Aramid honeycombs according to claim 2, wherein said pores each extend from a surface to a location inside of a respective one of said aramid sheets, and collectively provide said cell walls with a porosity of 20% to 60% by volume.

5. Aramid honeycombs according to claim 2, wherein at least 50% of the total volume of said pores is filled with said reinforcing resin.

6. Aramid honeycombs according to claim 1, wherein said cell walls are both coated by and impregnated with said reinforcing resin.

7. Aramid honeycombs according to claim 1, wherein each said aramid sheet is a calendered sheet, said pores therein being a result of the calendering.

8. Aramid honeycombs according to claim 1, wherein said aramid sheets further include para-aramid fibers, wherein said pores are dispersed within said cell walls, wherein said reinforcing resin coats and adheres to surfaces of said cell walls, and wherein said para-aramid pulps, said para-aramid fibers, said binder and said reinforcing resin are strong bonded to each other to form a strong three-dimensionally woven structure which is said assembly.

9. Aramid honeycombs according to claim 1, wherein said binder is a resin.

10. Aramid honeycombs according to claim 1, wherein said binder is one of a polyvinyl alcohol, a phenolic resin, an acrylate resin, a water-soluble thermosetting resin, and a water-soluble thermoplastic resin.

11. Aramid honeycombs according to claim 1, wherein said para-aramid pulps are made from a nylon type resin material.

* * * * *